US007326164B2

(12) United States Patent
Abe et al.

(10) Patent No.: US 7,326,164 B2
(45) Date of Patent: Feb. 5, 2008

(54) APPARATUS FOR MAKING WINDOW ENVELOPES

(75) Inventors: Kenji Abe, Koga (JP); Akihiko Nakao, Fukuoka (JP); Masahiro Naka, Sakura (JP); Masahiro Sumida, Chiba (JP)

(73) Assignees: Miyakoshi Printing Machinery Co., Ltd., Narashino (JP); AD. Printing Co., Ltd., Fukuoka (JP)

( * ) Notice: Subject to any disclaimer, the term of this patent is extended or adjusted under 35 U.S.C. 154(b) by 184 days.

(21) Appl. No.: 10/985,608

(22) Filed: Nov. 10, 2004

(65) Prior Publication Data

US 2006/0100082 A1 May 11, 2006

(51) Int. Cl.
*B31B 1/82* (2006.01)
*B05B 5/00* (2006.01)

(52) U.S. Cl. ..... 493/222; 493/919; 427/161; 427/379; 427/382; 427/391

(58) Field of Classification Search ..... 493/222, 493/224, 264, 265, 379, 382, 919, 925; 427/161, 427/379, 381, 382, 389.9, 391, 392, 209
See application file for complete search history.

(56) References Cited

U.S. PATENT DOCUMENTS

| | | | | |
|---|---|---|---|---|
| 2,319,116 A | | 5/1943 | Dodge | |
| 4,526,803 A | * | 7/1985 | White | 427/468 |
| 4,642,085 A | * | 2/1987 | Helm | 493/222 |
| 4,668,211 A | * | 5/1987 | Lubotta et al. | 493/188 |
| 5,207,592 A | * | 5/1993 | Loch | 493/216 |
| 5,410,857 A | * | 5/1995 | Utley | 53/410 |
| 5,465,842 A | * | 11/1995 | Utley | 206/390 |
| 5,852,915 A | * | 12/1998 | Williams et al. | 53/411 |
| 5,865,717 A | * | 2/1999 | Fabel | 493/216 |
| 6,143,120 A | * | 11/2000 | Mehta et al. | 156/272.2 |
| 6,692,819 B1 | | 2/2004 | Castle et al. | |
| 6,902,770 B1 | * | 6/2005 | Dulin et al. | 427/510 |

FOREIGN PATENT DOCUMENTS

| | | | |
|---|---|---|---|
| DE | 404 734 C | | 10/1924 |
| DE | 42 18 280 A1 | | 12/1993 |
| JP | 7-125478 | * | 5/1995 |
| JP | 7-216798 | * | 8/1995 |
| JP | 08 284097 | | 10/1996 |
| JP | 08-284097 | | 10/1996 |
| JP | 11-079190 | | 3/1999 |
| JP | 11 079190 | | 3/1999 |

* cited by examiner

*Primary Examiner*—Hemant M. Desai
(74) *Attorney, Agent, or Firm*—Cohen Pontani Lieberman & Pavane LLP

(57) ABSTRACT

Disclosed are a method and an apparatus designed to make a window envelope rapidly using a water-soluble clarifying agent without causing an inconvenience in its window area. Upstream of an envelope making stage wherein a continuous paper while traveling along a continuous path of travel is successively folded, pasted and cut to form an envelope, a water-soluble clarifying agent is applied to an area on the continuous paper that is designed to become the transparent window in the envelope and the continuous paper carrying the clarifying agent is wound on a plurality of drying cylinders so that its surface carrying the clarifying agent faces outwards to dry the clarifying agent while holding the surface of paper carrying the clarifying agent out of contact with the drying cylinders.

4 Claims, 7 Drawing Sheets

APPARATUS FOR MAKING WINDOW ENVELOPES

BACKGROUND OF THE INVENTION

1. Field of the Invention

The present invention relates to a method of and an apparatus for making window envelopes in which a clarifying agent is applied to a portion of paper making up an envelope to provide the envelope with a transparent window. The term "clarifying agent" is used herein to refer to a chemical agent which when applied to or carried in a part of paper acts to make that part of paper transparent.

2. Description of the Prior Art

While various types of the clarifying agent used to make a window portion of a paper envelope transparent have been proposed, it is desired that they be water-soluble together with the paper forming the envelope to allow such window envelopes after use to be recycled. For example, as described in JP H08-284097 A there is used a water-soluble clarifying agent in which 0 to 1.0 part by weight of silicone antifoaming or die-release agent and 0 to 20 parts by weight in active ingredient of a wax emulsion are added to 100 parts by weight in active ingredient of a resin and polymer solution obtained by neutralizing and making water-soluble 100 parts by weight in active ingredient of a mixture of carboxylated rosin resin and carboxylated acrylic polymer with 10 to 40 parts of ammonia water or one or a mixture of amines such as ethylenediamine or triethylamine or to 100 parts by weight in active ingredient of a mixture of that solution and 0 to 100 parts by weight in active ingredient of a solvent solution of styrene resin. Used as another water-soluble clarifying agent is sulfonated castor oil as described in JP H11-79190 A.

A clarifying agent to permit recycling must be water-soluble as mentioned above but as such is not much good in drying characteristics as those of UV curing type. Paper having a water-soluble clarifying agent applied thereto may, therefore, have to be passed over a roller while the clarifying agent has not enough been dried yet, and it is then very likely that parts of the undried solution upon contacting the roller are scraped off the paper, thereby mottling the window potion formed on the paper. Preventing this possibility requires the continuous paper carrying the clarifying agent to be slowed down in its rate of travel, but this then brings about inferiority in productivity of window envelopes.

BRIEF SUMMARY OF THE INVENTION

With the view to overcoming conventional difficulties as mentioned above, it is an object of the present invention to provide a method of and an apparatus for making window envelopes by using a water-soluble clarifying agent permitting their recycling whereby window envelopes can be produced rapidly and without having their window portions mottled.

In order to achieve the object mentioned above there is provided in accordance with the present invention in a first aspect thereof a method of making a window envelope in which a clarifying agent is applied to a portion of paper that makes up the envelope to provide the envelope with a transparent window, characterized in that the method comprises the steps of: upstream of an envelope making stage wherein a continuous paper such as paper web while traveling along a continuous path of travel is successively folded, pasted and cut to form the envelope, applying a water-soluble clarifying agent to an area on the continuous paper that is designed to become the transparent window in the envelope; and winding the continuous paper carrying the clarifying agent on a plurality of drying cylinders so that its surface carrying the clarifying agent faces outwards to dry the clarifying agent while holding the surface of paper carrying the clarifying agent out of contact with the drying cylinders.

The present invention also provides in a second aspect thereof an apparatus for making a window envelope in which a clarifying agent is applied to a portion of paper that makes up the envelope to provide the envelope with a transparent window, characterized in that the apparatus comprises: an envelope making means whereby a continuous paper while traveling along a continuous path of travel is successively folded, pasted and cut to form the envelope; and a clarifying agent applying means disposed mostupstream of the envelope making means and including: a plurality of drying cylinders disposed in a path along which the continuous paper travels; a looped drying path positioned to surround the drying cylinders to cause the continuous paper to travel around the drying cylinders with only one of its faces brought into contact with them, and a clarifying agent applicator disposed upstream of the drying path for applying a water-soluble clarifying agent to an area on the other face of the continuous paper that is not coming into contact with the drying cylinders, the area being designed to become the transparent window in the envelope, whereby the continuous paper past the clarifying agent applicator and the drying path in the clarifying agent applying means is allowed to advance into the envelope making means.

In an apparatus as mentioned above, the clarifying agent applying means and the envelope making means may include in their respective paths of travel of the continuous paper, components such as rollers and working members to make up the paths. The apparatus may then be characterized in that the components are each held out of contact with the area having the clarifying agent applied thereto.

In an apparatus as mentioned above, the clarifying agent applying means may include, mostupstream of the drying path, an adhesive applicator for applying an adhesive to an area designed to become a flap in the envelope and a dryer disposed downstream of the adhesive applicator for drying the adhesive applied to this area without contacting the same.

According to the present invention as mentioned above, in an envelope making means a continuous paper while traveling along a continuous path of travel is successively folded, pasted and cut to form an envelope. And, in a clarifying agent applying means disposed upstream of the envelope making means a water-soluble clarifying agent is applied by a clarifying agent applicator to an area on the continuous paper that is designed to become a transparent window in the envelope. The clarifying agent applied onto the continuous paper is allowed to dry while the continuous paper is driven to travel along a drying path, and it is then dried in the drying path without contacting drying cylinders disposed in the drying path. As a result, it is ensured that the clarifying agent applied to the continuous paper be not scraped off the paper by the drying cylinders before it is fully dried up.

Also, the proposed arrangement in the apparatus wherein components such as rollers and working members which make up the path of travel of the continuous paper are each held out of contact with an area having the clarifying agent applied thereto allows the continuous paper while traveling along its path of travel in the apparatus after it had the clarifying agent until it is cut into the finished envelope and discharged as the latter to travel without having its clarifying agent carrying area contact the path of travel components including a group of rollers and working members such as folding plows and plow-folding elements. As a result, it is ensured that the clarifying agent applied to the continuous paper be dried reliably and without the inconvenience that its applied surface gets caught or is otherwise disturbed until it reaches an endpoint of the envelope making stage.

Also, when the apparatus is provided with an adhesive applicator and a drier as mentioned above, an adhesive applied to an area designed to become a flap in the envelop is allowed, too, to reach the envelope making stage only after it is dried without getting scraped by the rollers or the like.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
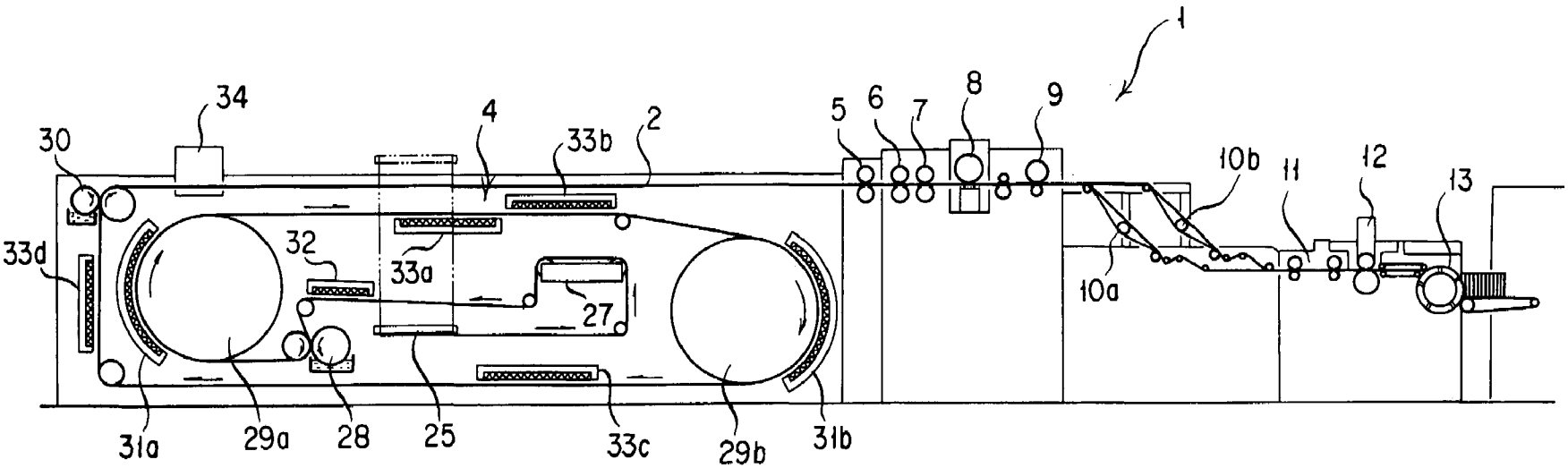
FIG. 1 is a front view illustrating an apparatus for making window envelopes which represents a certain embodiment of the present invention.

A suitable form of implementation of the present invention will now be described below with reference to the drawing Figures.

Figure 2:
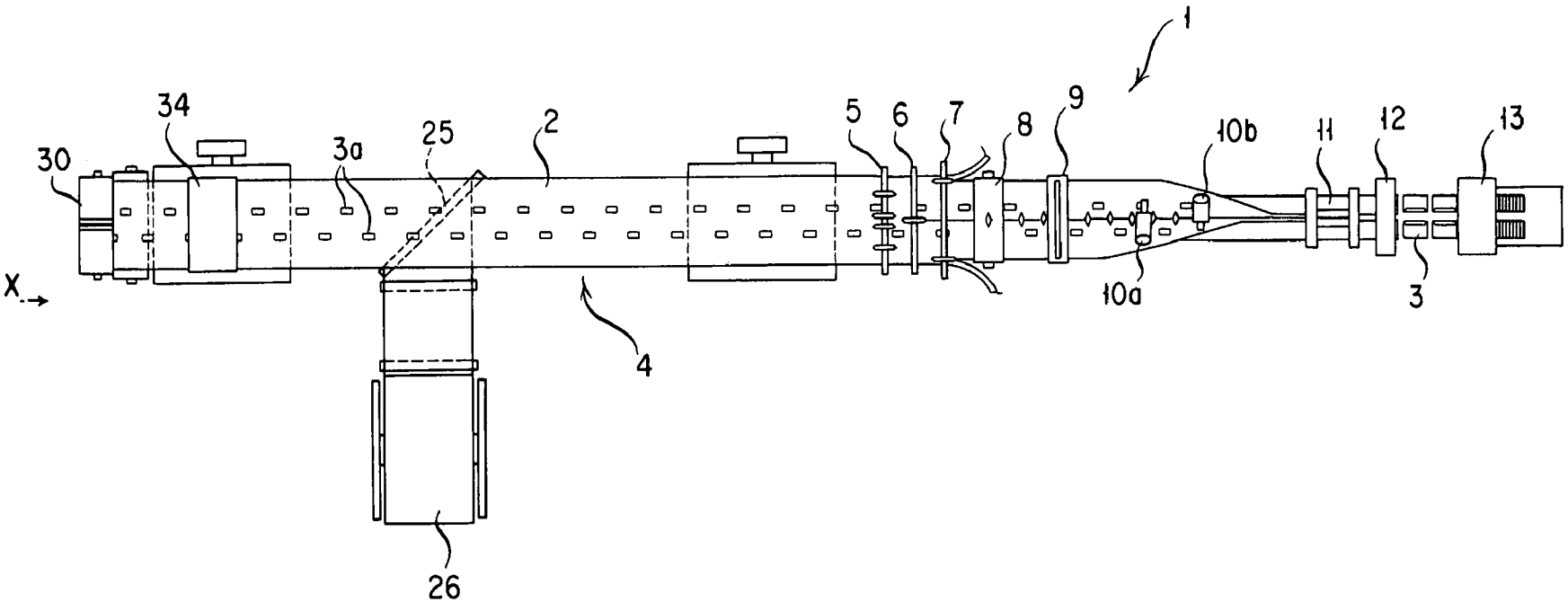
FIG. 2 is a top plan view illustrating the apparatus shown in FIG. 1.
Figure 3:
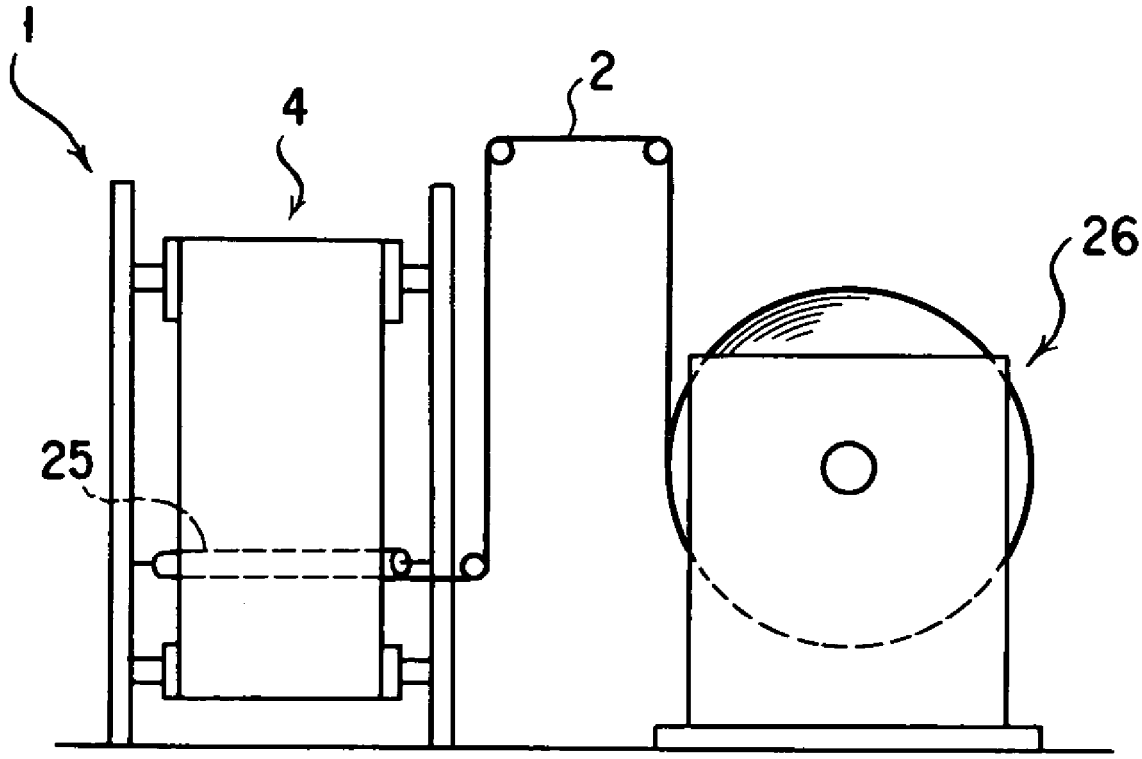
FIG. 3 is a side view of the apparatus as viewed in the direction of the arrow X in FIG. 2.
Figure 7:
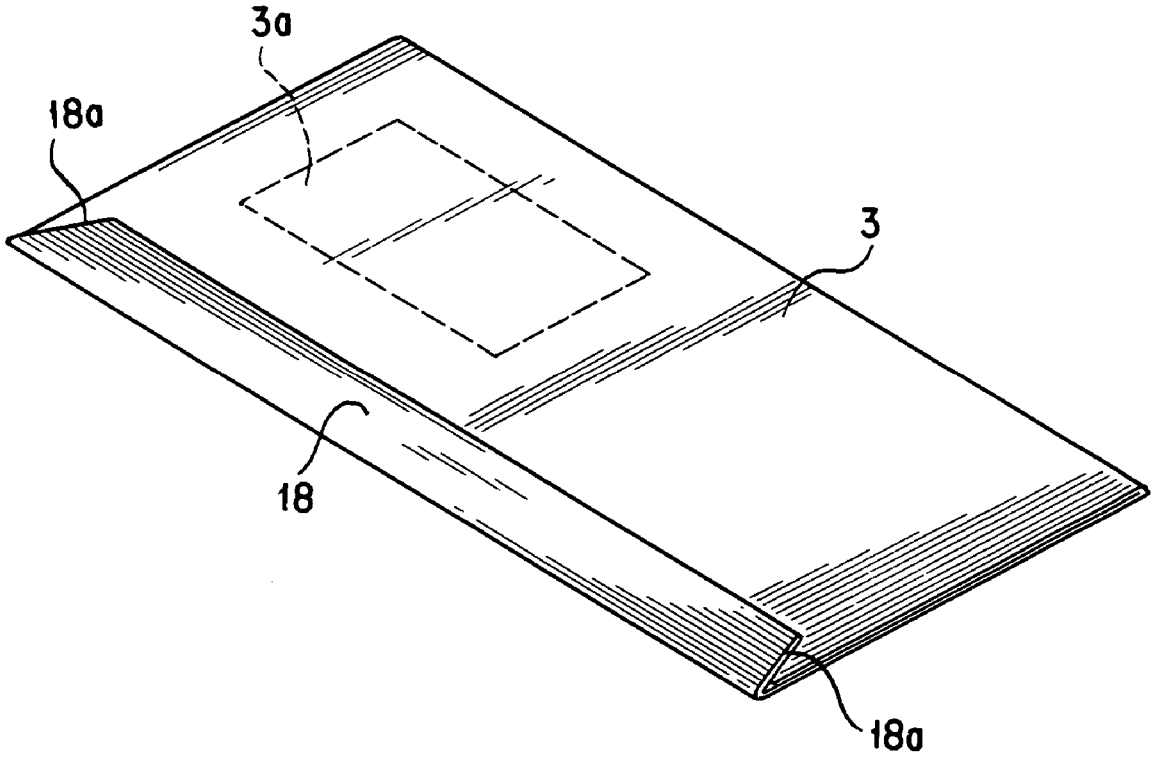
FIG. 7 is a perspective view illustrating one of envelopes made according to a method and an apparatus of the present invention.

Referring to FIGS. 1 to 3, there are shown an envelope making unit 1 for making window envelopes 3, each of which is as shown in FIG. 7, from a double-width continuous paper 2 while folding it up; and a clarifying agent applying unit 4 disposed upstream of the envelop making unit 1.

Included in the envelope making unit 1 and disposed in turn from its upstream side are a creaser 5, a center slitter 6, a double sided slitter 7, a die-cut roll 8, an adhesive applicator 9, a pair of plow folders 10*a* and 10*b*, a flap folder 11, a cutter 12 and a carrying out device 13.

Figure 6:
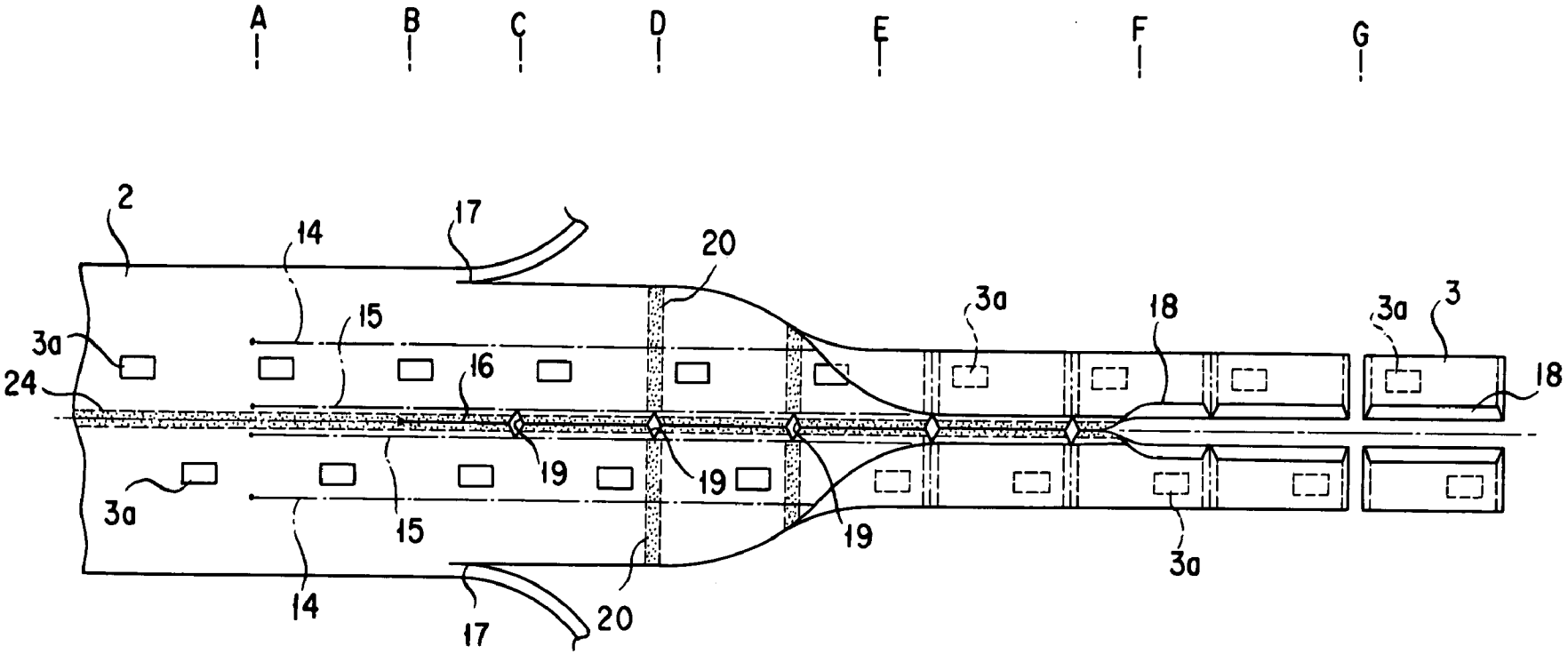
FIG. 6 is an explanatory view illustrating a step of folding in the course of forming envelopes.

According to this envelope making unit 1, a continuous paper 2 traveling out of the clarifying agent applying unit 4 is first subjected to creasing by the creaser 5 where as shown at A in FIG. 6 fold lines 14 and 14 and flap fold lines 15 and 15 are imparted thereto parallel to the direction of its travel for two sets of envelopes 3 and 3 to be made simultaneously. Then, the continuous paper 2 in step B of FIG. 6 is passed through the center slitter 6 and the double-sided slitter 7 where it is formed therein with a center slit 16 to divide it into its two halves from which a first and a second series of envelopes 3 are to be formed and further with a pair of outer side slits 17 to remove their respective outer edge portions, thereby leaving a sized continuous paper, namely a continuous paper whose width is sized to double a desired width of envelopes 3.

Thereafter, in step C of FIG. 6 the die-cut roll 8 punches holes 19 to form cutoffs 18*a* and 18*b* defining the opposite side edges of the flap 18 of each envelope 3 as shown in FIG. 7. Then, in step D of FIG. 6 the adhesive applicator 9 applies adhesive to a narrow elongate area 20 on the continuous paper 2 extending across its entire width perpendicular to its direction of travel and at a center line of the area 20 two lengthwise adjacent areas becoming two successive envelopes 3 and 3 in each of their first and second series are to be severed from each other. It is thus seen that adhesive is applied to each of parallel such strip areas 20 which are spaced from one another by a distance that is equal to a desired length of envelopes 3. It is also seen that each of such adjacent areas shown facing front in the Figure becomes the reverse side of each envelope 3. Subsequently, in step E of FIG. 6 the sized continuous paper 2 is passed between the two plow folders 10*a* and 10*b* whereby it is folded inwards along the fold lines 14 and 14, and in step F of FIG. 6 the flap folder 11 folds the flaps 18 of widthwise adjacent envelopes 3 being formed in the first and second series along the fold lines 15 and 15 while separating them from each other. At this time, the widthwise first and second parts (upper and lower parts as shown) of each of the parallel elongate areas 20 located at the opposite sides of an envelope being formed have been pasted together by adhesive. Thereafter, in step G of FIG. 6 the cutter 12 makes a cut along the center line of a pasted elongate area 20 in each of the first and second parts so that each time a cut is made two pairs of envelopes 3 are yielded each of which has its longitudinal opposite sides closed by pasting and has its flap 18 folded and are discharged onto the conveyer 13.

Here, in this envelope making unit 1 all the components disposed in the path of travel of a continuous paper 2, including the creaser 5, a cylinder in each of the slitters 6 and 7, the die-cut roll 8, the adhesive applicator 9, the plow folders 10*a* and 10*b*, the flap folder 11, the cutter 12 and their associated rollers are each arranged not to contact an area on the continuous paper 2 which is destined to become a transparent window 3*a* and to which clarifying agent has been applied.

Figure 4A:
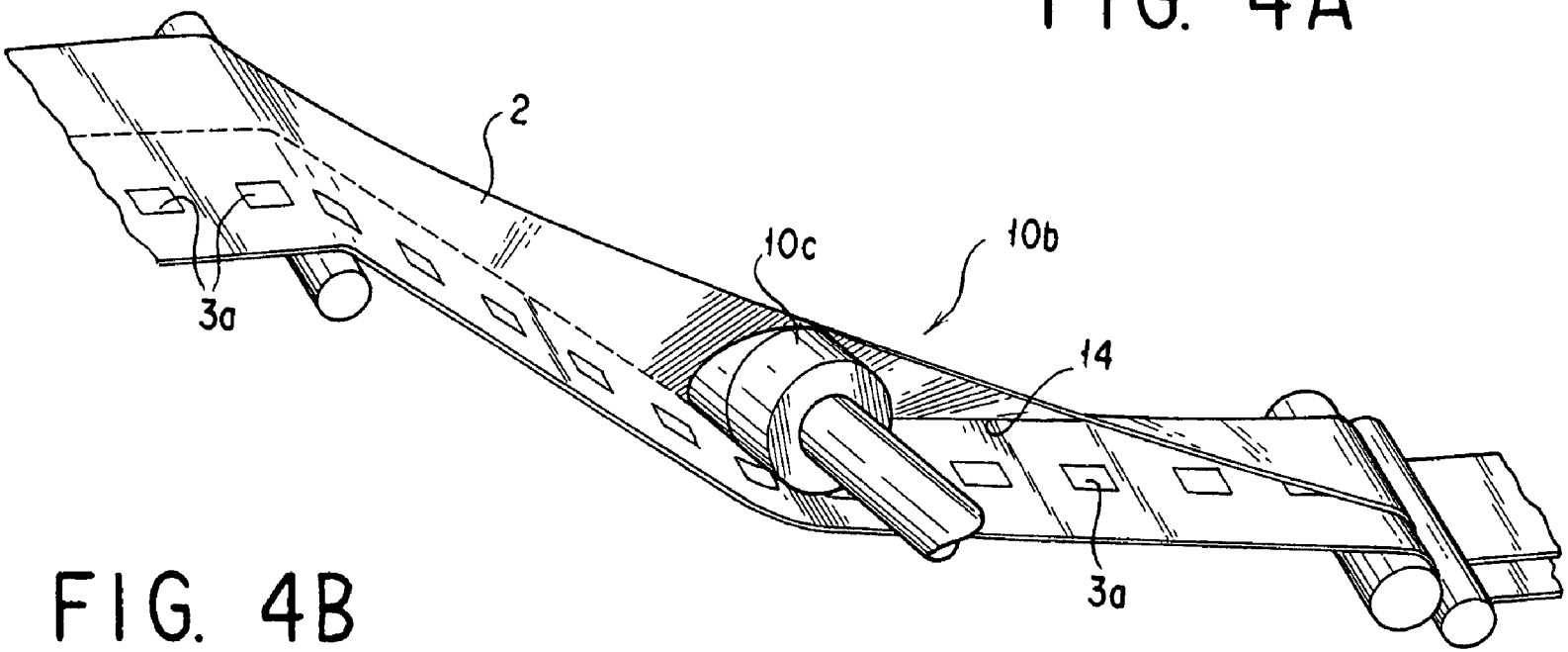
FIG. 4A is a perspective view diagrammatically illustrating an essential part of a plow folder.
Figure 4B:
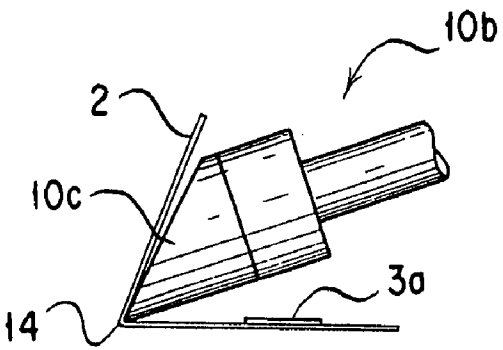
FIG. 4B is a perspective view diagrammatically illustrating an operation of the plow folder.

FIGS. 4A and 4B show one of the plow folders, 10*b*. The plow folder 10*b* has a plow 10*c* formed to taper towards its end, and it is disposed so that this tapered end is held in contact with the fold line 14 on the continuous paper 2 but its other portions, especially the lower part of its cylindrical portion, are held out of contact with the continuous paper 2 as shown in FIG. 4B, while one half of the continuous paper 2 divided by the center slitter 6 around its center line is being folded along the fold line 14 with the plow 10*c* as shown in FIG. 4A. In this Figure, it is seen that cutoffs 18*a* for a flap 18 are omitted from illustration.

Figure 5:
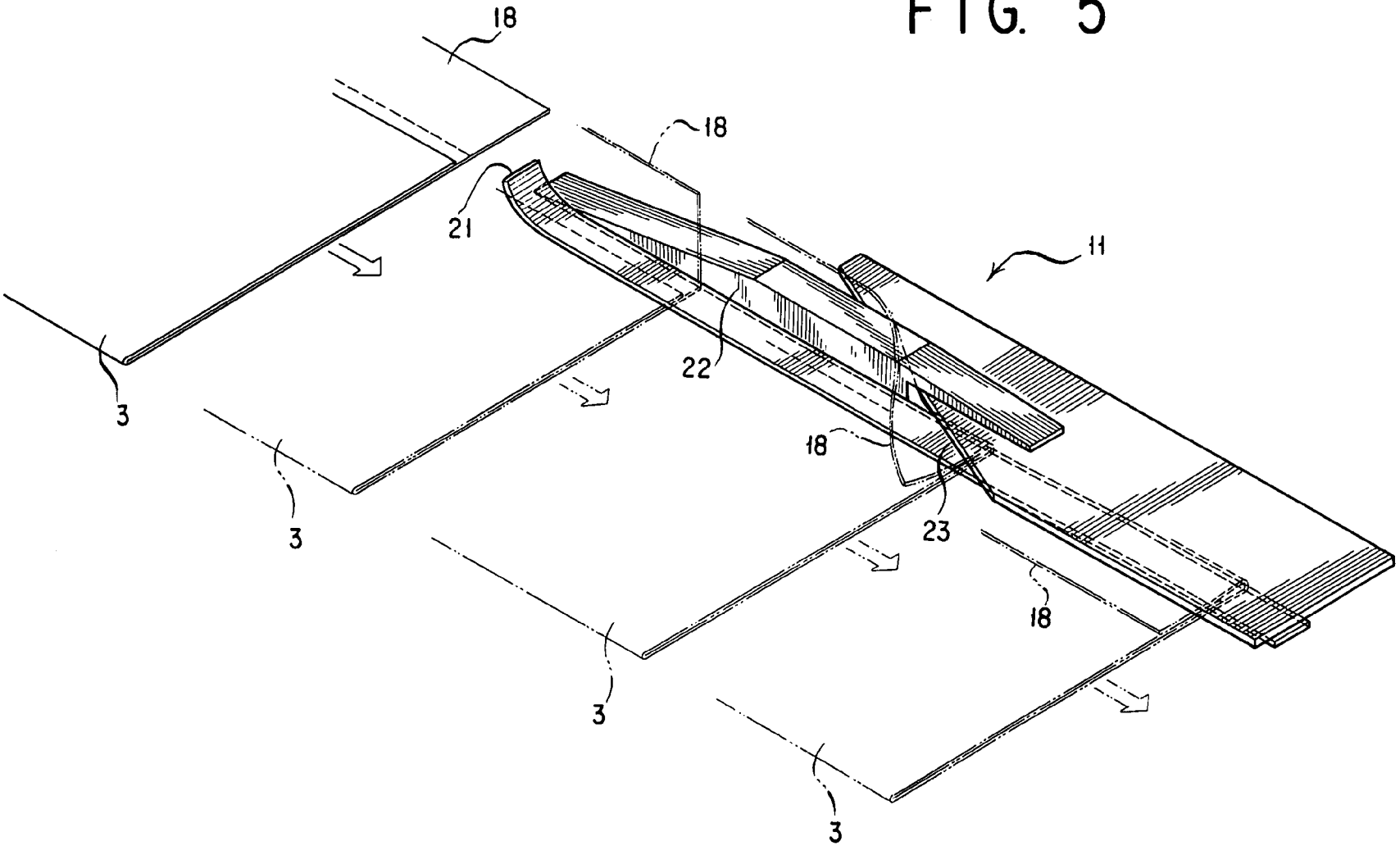
FIG. 5 is a perspective view diagrammatically illustrating and essential part and an operation of a flap folder.

The flap folder 11 mentioned above is constructed as shown in FIG. 5. It comprises an envelope holder 21 whereby the open side end of an envelope adjacent to its flap 18 is held from above it, a turn-up guide piece 22 for scooping the flap 18 up to raise it to stand upright, and a fold-down guide piece 23 for folding the flap over 180 degrees whereby the flap 18 when passing through the flap folder 11 is folded along the fold line 15 on an envelope to close its opening.

A continuous paper 2 before it is fed into the envelope making unit 1 described above is processed at its upstream by the clarifying agent applying unit 4 referred to above. The clarifying agent applying unit 4 applies a clarifying agent to each of areas which are destined to become transparent windows 3*a* of window envelopes 3 and also applies an adhesive 24 to each of areas which are destined to become folded flaps 18, the adhesive 24 developing adhesiveness when wetted in the use of an envelope.

The clarifying agent applying unit 4 is constructed as shown in FIGS. 1 to 3 and is disposed upstream of the envelope making unit 1 and as an extension thereof. Longitudinally midway of the clarifying agent applying unit 4 there is disposed a turn bar 25 designed to turn a continuous paper 2 supplied laterally to redirect it in one of longitudinal directions of the clarifying agent applying unit 4, e. g., towards the envelope making unit 1 (towards "the unit downstream side"). Dispose upstream of the turn bar 25 and laterally to the clarifying agent applying unit 4 is a paper supply 26 designed to feed the turn bar 25 with a continuous paper 2 with its front surface facing upwards.

Downstream ("paper-downstream") of the turn bar 25 there is provided an inverter 27 designed to invert the continuous paper 2 or direct it towards the side opposite to the side of the envelope making unit 1 (towards the "unit upstream side"), and paper-downstream of the inverter 27 there is disposed a clarifying agent applicator 28 designed to apply a water-soluble clarifying agent to each of selected areas destined to become the transparent windows 3*a* on the continuous paper 2 on its reverse side.

And, disposed at the paper-downstream of this clarifying agent applicator 28 is a drying path comprising a plurality of, say two, drying cylinders 29*a* and 29*b* on which the continuous paper 2 is to be wound in a loop so that its reverse side on which the clarifying agent has been applied to each of the selected areas lies outside and that the continuous paper 2 past the downstreammost drying cylinder 29*b* enters the envelope making unit 1 with its reverse side facing upwards. Further, disposed at the paper-downstream of this downstreammost drying cylinder 29*b* there is also an adhesive applicator 30 designed to apply the above-mentioned adhesive 24 to the area on the reverse side of the continuous paper 2 around its longitudinal center line that is destined to become flaps 18.

Each of the drying cylinders 29*a* and 29*b* incorporates a heater and is adapted to be heated thereby. They are also provided with driers 31*a* and 31*b* which are disposed each outside of the areas where the continuous paper 2 is wound. Further, a pre-heater 32 is disposed in a path between the inverter 27 and the clarifying agent applicator 28 to heat the continuous paper 2 passing therethrough. Furthermore, in a path between the first and second drying cylinders 29*a* and 29*b* and in a path between the second drying cylinder 29*b* and the adhesive applicator 30 there are provided driers 33*a*, 33*b*, 33*c*, . . . to heat one and/or the other faces of the continuous paper 2 passing therethrough, respectively. And, the driers 31*a*, 31*b*, 33*a*, 33*b*, 33*c*, . . . and the pre-heater 32 are held out of contact with the continuous paper 2 passing adjacent thereto, respectively.

Also, at the paper-downstream side of the adhesive applicator 30 there is provided a high-frequency drier 34 opposed to but held out of contact with the reverse side of the continuous paper 2. In this clarifying agent applying unit 4 it is ensured that all the components provided in its entire path of travel of the continuous paper 2, including the adhesive applicator 30, are each held out of contact with the clarifying agent applied to each of the areas destined to become the transparent windows 3*a*.

In the operation of the clarifying agent applying unit 4 constructed as mentioned above, a continuous paper 2 supplied from the paper supply 26 is inverted by the turn bar 25 to turn its reverse side to face upwards and then inverted by the inverter 27 which redirects it towards the unit-upstream side. In this subsequent path of travel, the clarifying agent applicator 28 applies a water-soluble clarifying agent to each of the selected areas on the reverse side of the continuous paper 2 which are destined to become transparent windows 3*a* of envelopes 3, prior to which the continuous paper 2 is heated by the pre-heater 32.

The continuous paper 2 having the clarifying agent applied to its reverse side is wound around and looped on the two drying cylinders 29*a* and 29*b* so that its front side free of the clarifying agent lies inside, and is allowed to travel as they are rotated. While it is so traveling, the continuous paper 2 has its front side heated directly by contacting with the drying cylinders 29*a* and 29*b* and its reverse side with the clarifying agent heated by non-contacting with the driers 31*a* and 31*b* and its both sides separately heated by the driers 33*a*, 33*b*, 33*c*, . . . in combination whereby the clarifying agent applied to the reverse side of the continuous paper 2 is dried while the reverse side of the continuous paper 2 having the clarifying agent applied thereto is completely held out of the heating members such as the drying cylinders. Here, the driers 31*a*, 31*b*, 33*a*, 33*b*, 33*c*, . . . may not only be drying by heating the clarifying agent but may also be drying by blowing cold blast against the clarifying agent to dry and harden the same.

The continuous paper 2 past the downstreammost drying cylinder 29*b* is fed to the envelope making unit 4 with its reverse side facing upwards. Before then, the continuous paper 2 immediately past the downstreammost drying cylinder 29*b* has its selected area on the reverse side applied with the adhesive 24 by the adhesive applicator 30, the selected area-being the area destined to become flaps 18 of envelopes 3. And, the adhesive 24 is dried by the high-frequency drier 35 disposed opposed to but held out of contact with the reverse side while any area having the clarifying agent applied thereto is then also held out of contact with the adhesive applicator 30 as well.

Although in the apparatus makeup mentioned above an example is taken of providing two drying cylinders in the clarifying agent applying unit 4, the number of such drying cylinders to be provided can be altered adequately depending on the length of the looped drying path which is made up of them. This likewise applies to the number of the heaters and the driers to be provided in the drying path. The drying path is designed to be of a length sufficient to dry the clarifying agent applied on the continuous paper 2 while it is traveling rapidly.

According to the present invention, a clarifying agent that makes up a transparent window, which is applied to a continuous paper by a clarifying agent applying means before the continuous paper is supplied to an envelop making means, can be dried by drying cylinders and without contacting them while it passes rapidly through a drying path made up of them. Since this permits the continuous paper with the water-soluble clarifying agent fully dried to be fed rapidly to the envelope making means while preventing a window area to be made transparent by the clarifying agent from becoming mottled, it is possible to rapidly make window envelopes using a clarifying agent without any inconvenience such as that transparent window areas become mottled. Moreover, since the envelope making means is also designed to include no component in its path of travel of continuous paper that contacts any area thereon carrying the clarifying agent, it is possible to keep the clarifying agent drying for long and reliably until the continuous paper has been folded to finish preparing window envelopes.

According to the present invention, an adhesive for the flap can also be made fully dried, as can be the clarifying agent as mentioned above, before the continuous paper carrying the same is fed to the envelope making means.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences and scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. An apparatus for making a window envelope in which a clarifying agent is applied to a portion of paper that makes up the envelope to provide the envelope with a transparent window, wherein the apparatus comprises:

an envelope making means for acting on a continuous paper while the continuous paper is traveling along a continuous path of travel so that the continuous paper is successively folded, pasted and cut to form the envelope; and a clarifying agent applying means disposed upstream of said envelope making means and comprising:

(a) a plurality of drying cylinders disposed in a path along which the continuous paper travels;

(b) a looped drying path positioned to surround said drying cylinders to cause the continuous paper to travel around said drying cylinders with only one face of the continuous paper being brought into contact with said drying cylinders, and (c) a clarifying agent applicator means disposed mostupstream of said drying path for applying a water-soluble clarifying agent to an area on the other face of the continuous paper that is not brought into contact with said drying cylinders, said area being adapted to become the transparent window in the envelope, whereby the continuous paper that has traveled past said clarifying agent applicator and said drying path in said clarifying agent applying means is allowed to advance into said envelope making means.

2. An apparatus as set forth in claim 1, wherein said clarifying agent applying means and said envelope making means have respective paths of travel therethrough for the continuous paper that include rollers and working members as components of said paths, and wherein said components are each held out of contact with said area having the clarifying agent applied thereto.

3. An apparatus as set forth in claim 2, wherein said clarifying agent applying means includes, mostupstream of said drying path, an adhesive applicator for applying an adhesive to an area designed to become a flap in the envelope and a dryer disposed downstream of said adhesive applicator for drying the adhesive applied to this area without contacting the adhesive applied.

4. An apparatus as set forth in claim 1, wherein said clarifying agent applying means includes, mostupstream of said drying path, an adhesive applicator for applying an adhesive to an area designed to become a flap in the envelope and a dryer disposed downstream of said adhesive applicator for drying the adhesive applied to this area without contacting the adhesive applied.

* * * * *